United States Patent [19]

Nishino

[11] 4,081,875

[45] Apr. 4, 1978

[54] SCALE REMOVAL DEVICE

[76] Inventor: Eizo Nishino, 2-7-9, Sanno Yahata Higashi-ku, Kitakyushu-shi, Fukuoka-ken, Japan

[21] Appl. No.: 740,603

[22] Filed: Nov. 10, 1976

[30] Foreign Application Priority Data

Nov. 15, 1975 Japan ..... 50-155768[U]

[51] Int. Cl.[2] ..... B08B 9/04

[52] U.S. Cl. ..... 15/104.06 R

[58] Field of Search ..... 15/104.05, 104.06 R, 15/104.06 A, 104.09, 104.12, 104.13

[56] References Cited

U.S. PATENT DOCUMENTS 1,588,765 6/1926 Mannion et al. ..... 15/104.06 R 2,596,571 5/1952 Lewenhagen ..... 15/104.06 R

*Primary Examiner*—Edward L. Roberts

*Attorney, Agent, or Firm*—Woodling, Krost, Granger & Rust

[57] ABSTRACT

A scale removal device for scraping off scale deposited on the inner surface of a tube section comprising a rotary shaft to be received within said tube section for advancement and rotation under the action of fluid under pressure pumped into the tube section and having a spiral blade thereabout, a scraper head detachably connected to the leading end of said rotary shaft and having resilient scraper blades thereabout for yieldingly abutting against the inner surface of said tube section and connector means detachably connecting said rotary shaft and scraper head.

6 Claims, 4 Drawing Figures

SCALE REMOVAL DEVICE

BACKGROUND OF THE INVENTION

This invention relates to scale removal devices for scraping off scale deposited on the inner surface of tube sections and more particularly, to scale removal devices for scraping off soft and viscous scale deposited on the inner surface of tube sections which form part of the piping system of a chemical apparatus or heat exchanger.

There have been proposed and practically employed a great variety of devices for removing scale deposited on the inner surface of the tube sections of the piping systems of chemical apparatus and heat exchangers. In one of the conventional scale removal devices, a brush having bristles is forced to pass through within the tube section together with water under pressure with the tips of the bristles maintained in yielding abutment against the inner surface of the tube section. However, such a scale removal device employing the bristle brush has the disadvantage that the inner surface of the tube section is damaged or scale cannot be effectively removed the tube section inner surface depending upon whether the brush bristles are too rigid or too flexible and/or the pressure of water is too high or too low.

SUMMARY OF THE INVENTION

Therefore, one object of the present invention is to provide a scale removal device for tube sections which can effectively eliminate the disadvantages inherent in the prior art scale removal devices.

Another object of the present invention is to provide a scale removal device for tube sections which substantially comprises a rotary shaft to be received with a tube section in co-axial relation to the tube section having a spiral blade thereabout extending along a substantial length of the shaft and a center bore extending from the leading end of said shaft, a resilient stopper provided at a leading end of the shaft, a scraper head detachably connected to said rotary shaft at one end for rotation opposite to that of the shaft and having a plurality of resilient scraper blades thereabout extending radially outwardly and rearwardly from the body of said scraper head in yielding abutment against the inner surface of said tube section, and a connector rod to connect the scraper head and shaft together for joint advancement and opposite rotation. In operation, fluid under pressure is pumped into said tube section at one end adjacent to the rear end of said rotary shaft to advance and rotate the shaft at a high rate which in turn advances and rotates oppositely said scraper head at a reduced rate to thereby scrape off scale deposited on the inner surface of said tube section.

The above and other objects and attendant advantages of the present invention will be more readily apparent to those skilled in the art from a reading of the following detailed description in conjunction with the accompanying drawing which shows preferred embodiments of the invention for illustration purpose only, but not for limiting the scope of the same in any way.

PREFERRED EMBODIMENTS OF THE INVENTION

Figure 1:
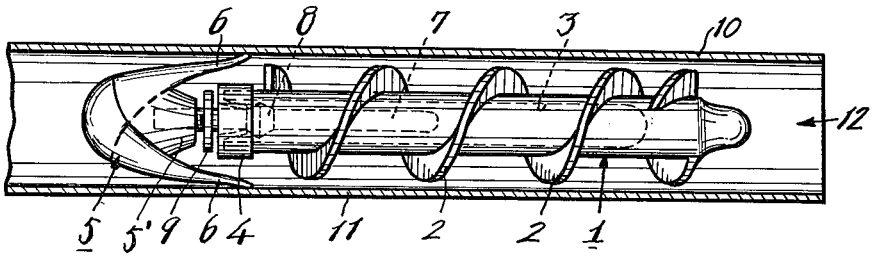
FIG. 1 is a side elevational view of a first embodiment of scale removal device constructed in accordance with the principle of the present invention showing the device as being disposed within a tube section from which scale is to be removed.
Figure 2:
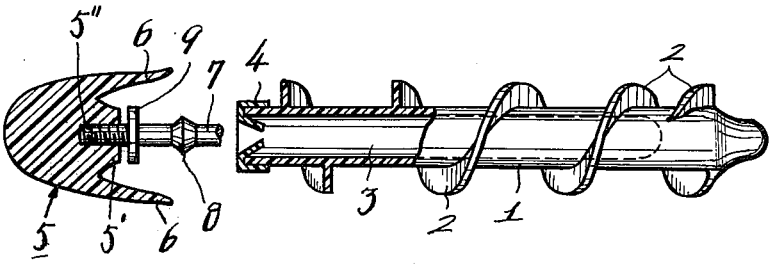
FIG. 2 is a side elevational view of said scale removal device as shown in FIG. 1 with a portion thereof broken away and with another portion thereof shown in section.
Figure 3:
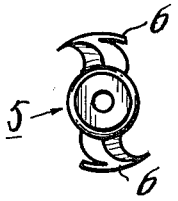
FIG. 3 is an end elevational view of the scraper head of said scale removal device.

The present invention will be now described referring to the accompanying and more particularly, to FIGS. 1 through 3 thereof in which the first embodiment of scale removal device of the invention is shown. In FIG. 1, reference numeral 10 denotes a tube section which is a part of the piping system of a chemical apparatus or heat exchanger. The scale removal device of the invention is received within the tube section 10 with the axis of the device coaxial with that of the tube section to remove scale deposited on the inner surface of the tube section. The scale removal device substantially comprises a substantially hollow rotary shaft 1 which has an integral spiral blade 2 on the outer periphery substantially throughout its length and is adapted to be advanced and rotated by the force of fluid under pressure which is pumped into the tube section 10 at the rear or right-hand end of the tube section (as seen in FIG. 1). The rotary shaft 1 is provided with a center bore 3 which extends from the leading or left-hand end (as seen in FIG. 1) and terminates short of the rear or right-hand end (as seen in FIG. 1) of the shaft. An annular resilient stopper 4 is provided at the inlet of the center bore 3 with a portion surrounding the shaft 1 at the leading end thereof and another resilient portion extending into the bore 3 for the purpose to be described below. A semi-oval cross-section scraper head 5 is connected to the leading or left-hand end of the rotary shaft 1 and has a pair of diametrically opposite resilient integral scraper blades 6,6 which extend radially outwardly and rearwardly from the body of the scraper head. The scraper blades 6 are adapted to yieldingly abut against the inner surface of the tube section 10 to scrape off scale deposited on the tube section inner surface as the scraper head 5 advances and rotates oppositely to the rotary shaft 1 within the tube section 10. The scraper head 5 further has a boss 5' extending inwardly from the body of the scraper head and provided with a central threaded bore 5''. A connector rod 7 is screwed at the threaded left-hand end thereof in the threaded bore 5'' in the scraper head 5 and has a hexagonal longitudinal-section bulge 8 between the opposite ends of the connector rod. After the scraper head 5 has been threadably connected to the connector rod 7 the plain right-hand end of the connector rod 7 is inserted into the center bore 3 in the rotary shaft 1 until the bulge 8 passes beyond the stopper 4 whereby the scraper head 5 is detachably connected to the rotary shaft 1 for advancement and opposite rotation with the latter. When the scraper head 5 is desired to be disconnected from the rotary shaft 1, it is only necessary to pull the scraper head and connector rod assembly outwardly from the rotary shaft 1 until the bulge 8 on the connector rod 7 clears the stopper 4 in the removal direction movement. The insertion and removal of the connector rod 7 into and out of the rotary shaft 1 is accelerated by the resilience of the yielding portion of the stopper 4 which extends into the center bore 3. In FIGS. 1 and 2, reference numeral 9 denotes a washer in threaded engagement with the right-hand end of the threads of the connector rod 7. Reference numeral 11 denotes scale deposited on the inner surface of the tube section 10 to be removed by the device of the invention and reference numeral 12 denotes fluid under pressure which is pumped into the tube section 10 at the right-hand end thereof to rotate the rotary shaft 1.

Figure 4:
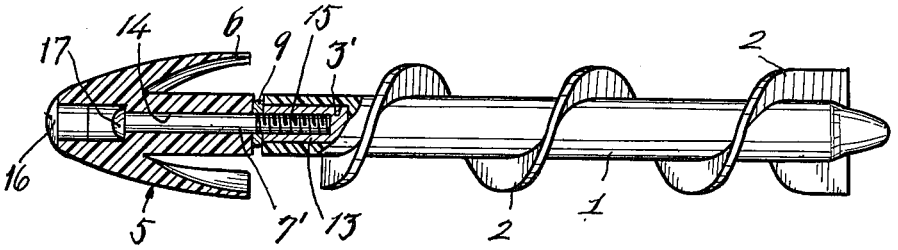
FIG. 4 is a side elevational view of a second embodiment of scale removal device constructed in accordance with the principle of the present invention with a portion thereof shown in section.

Referring now to FIG. 4 of the accompanying drawing which shows the second embodiment of scale removal device of the invention. The second embodiment is substantially similar to the first embodiment except for the connection arrangement between the rotary shaft and scraper head. Thus, the corresponding parts of the second embodiment are assigned thereto the same numerals which are employed for the similar parts of the first embodiment. Description will be had on only the parts of the second embodiment which are different from those of the first embodiment. The rotary shaft 1 is provided with a center bore 3' which extends from the leading or left-hand end of the shaft by a distance substantially shorter than the center bore 3 in the rotary shaft 1 in the first embodiment. An internally threaded nut 13 is embedded in the center bore 3' for the purpose to be described hereinbelow. The semi-oval cross-section scraper head 5 has the diametrically opposite resilient scraper blades 6 as in the case of the scraper head in the first embodiment and also has a center stepped through bore 14. A connector rod 7' in the form of a bolt has one plain end extending through the smaller diameter portion of the through bore 14 and the other threaded end 15 screwed in the embedded nut 13. The head 17 of the connector rod 7 is received within the larger diameter portion of the through bore 14 and abuts against the shoulder defined between the smaller and larger diameter portions of the through bore 14 whereby the rotary shaft and scraper head are connected together. Reference numeral 16 denotes a cover partially fitted in the larger diameter portion of the through bore 14 to close the through bore.

With the above construction and arrangement of the parts of the scale removal device of the invention, the operation of the device is as follows:

The spiral blade 2 and the scraper blades 6 are of opposite hand. The spiral blade 2 may be a left hand thread, as shown in FIGS. 1 and 2, and the scraper blades 6 may be right hand, as shown in FIG. 3. Also the pitch of the thread of the spiral blade 2 is much smaller than that of the scraper blades 6. Connector rod 7 connects the head 5 to the rotary shaft 1 only for longitudinal thrust and permits opposite rotation of the shaft 1 and head 5.

Before the scale removal operation is performed on the tube section 10, the scale removal device is inserted into the tube section 10 from the rear or right-hand end (as seen in FIG. 1) with the scraper head 5 in the lead until the device is positioned for a proper scraping operation within the tube section. With the device positioned properly within the tube section, the scraper blades 6 of the scraper head 5 yieldingly abut against the inner surface of the tube section 10. In operation, fluid under high pressure 12 is pumped from an external fluid source (not shown) to and into the tube section 10 at the rear or right-hand end thereof and the thus pumped fluid under pressure acts on the spiral blade 2 on the rotary shaft 1 to advance and rotate the shaft at a high rate producing a longitudinal thrust. As the shaft 1 rotates clockwise, as viewed from the rear, it rotates at high speed due to the small thread pitch. A longitudinal reaction thrust is imparted to the entire device to advance the device through the tube section 10. The spiral blade is forced to rotate clockwise and the pumped fluid rotates somewhat counter clockwise as a reaction force. This slight counter clockwise movement of the pumped fluid then impinges on the right hand thread disposed scraper blades 6 to impart a slow counter clockwise rotation to the head 5 despite the yielding abutment of the blades 6 against the inner surface of the tube section 10.

When a fluid is pumped under high pressure into a particular pipe section, a portion of such fluid impinges against the spiral blade 2 of the rotary shaft 1 to rotate the shaft at a high speed whereas another portion of the fluid passes along the clearance between the wall of the tube section 10 and shaft 1 to impinge against the scraper blades 6 to rotate the scraper head 5. However, since the scraper blades 6 are in yielding abutment against the tube section 10, the rotational speed of the scraper head 5 is substantially lower than the rotational speed of the shaft 1. In this way, the scale deposited on the inner surface of the tube section 10 can be effectively and positively scraped off. After having passed through the tube section 10 for one scraping operation, the scale removal device discharges at the left-hand end of the tube section to be received into a receptacle (not shown) which is positioned below the left-hand end of the tube section. Thereafter, the device is again inserted into the tube section 10 at the left-hand end thereof at this time and fluid under high pressure is pumped into the tube section at the left-hand end to advance the device in the reverse direction or from left to right while rotating the device to scrape off scale deposited on the inner surface of the portion of the tube section which was positioned rearwardly of the scraper head after the insertion of the device into the tube section, but prior to the operation of the device and not subjected to the scraping action of the scraper head in the previously described scraping operation when the rotating device was moved from right to left. And according to the present invention, by suitably regulating the abutment force applied by the resilient scraper blades against the tube section inner surface and the flow rate of the fluid under pressure, the combined action of the fluid under pressure which is struck against the inner surface of the tube section by the rotating blade 2 and the opposite rotation and scraping abutment of the scraper head 5 can positively and effectively scrape off scale throughout the full length of the inner surface of the tube section. The shaft having the integral spiral blade, stopper and the scraper head having the resilient scraper blades are formed of a rigid plastic.

As clear from the foregoing description of preferred embodiments of the invention, according to the present invention, since the scraper head having the resilient scraper blades thereon yieldingly abuting against the inner surface of the tube section is detachably connected to the leading end of the rotary shaft having the spiral blade thereon for advancing and rotation opposite to the shaft, while the shaft is advancing and rotating at a high rate to produce a longitudinal thrust, the scraper head advances while rotating oppositely at a slower rate by virtue of the opposite hand of the spiral blade and scraper head blades to thereby perfectly scrape off the scale deposited on the inner surface of the tube section.

Furthermore, since the scraper head is detachably connected to the rotary shaft, when the resilient scraper blades have worn away or have been damaged, the scraper head can be simply and rapidly replaced by a new scraper head. In addition, the scale removal device of the invention is quite simple in construction and operation without requiring skilled personnel and can be produced at a relatively less expense.

While only two embodiments of the invention have been shown and described in detail it will be understood that the same are for illustration purpose only and not to be taken as a definition of the invention, reference being had for the purpose to the appended claims.

What is claimed is:

1. A scale removal device for scraping scale from the inner surface of tube sections, comprising, in combination, a rotary shaft to be received coaxially in a tube section to be scraped, a spiral blade secured to and around said shaft and extending along a substantial portion of the length of said shaft, a center bore extending into a leading end of the shaft, a scraper head having a plurality of resilient scraper blades extending radially outwardly and rearwardly in yielding abutment against the inner surface of the tube section, said spiral blade and said scraper blades being of opposite hand, and connector means detachably longitudinally connecting said scraper head to said rotary shaft for joint advancement and opposite rotation.

2. The scale removal device as set forth in claim 1, in which said rotary shaft further has a resilient stopper at the leading end of the shaft with a portion of said stopper surrounding the leading end of the shaft and another portion extending into said center bore in the shaft and said connector means comprises a rod having a threaded end and a plain end with a bulge therebetween, said threaded end screwed in a threaded hole in said scraper head and said plain end extending into said center bore in the shaft with said bulge resiliently engaged by said stopper.

3. The scale removal device as set forth in claim 1, in which said center bore extends a substantial distance along the length of said rotary shaft from said leading end and terminates short of the rear end of the shaft.

4. The scale removal device as set forth in claim 1, in which said center bore extends from said leading end of the shaft a short distance, and an internally threaded nut is received in said center bore.

5. The scale removal device as set forth in claim 4 in which said connector means comprises a bolt-shaped rod having a headed end extending through a through center bore in said scraper head and having a threaded end screwed into said nut.

6. The scale removal device as set forth in claim 1, wherein the pitch of said spiral blade is considerably smaller than the pitch of said scraper blades.

* * * * *